US005443331A

United States Patent [19]

Seegmiller

[11] Patent Number: 5,443,331

[45] Date of Patent: Aug. 22, 1995

[54] THREADED BAR CONSTRUCTION

[76] Inventor: Ben L. Seegmiller, 143 S. 400 East, Salt Lake City, Utah 84111

[21] Appl. No.: 106,527

[22] Filed: Aug. 16, 1993

[51] Int. Cl.[6] ..... E21D 21/02

[52] U.S. Cl. ..... 405/259.1; 411/417

[58] Field of Search ..... 405/259.1, 259.2, 259.5, 405/259.6; 411/417, 418

[56] References Cited

U.S. PATENT DOCUMENTS

| | | | |
|---|---|---|---|
| 1,048,590 | 12/1912 | Russell | 411/417 |
| 1,440,613 | 1/1923 | Mathias | 411/417 |
| 1,987,474 | 1/1935 | Grant | 411/417 |
| 4,630,971 | 12/1986 | Herbst et al. | 405/259.1 X |
| 5,234,291 | 8/1993 | Swemmer | 405/259.1 |

OTHER PUBLICATIONS

ASTM Publication F 432-83, Rouf and Rock Bolts and Accessories.

*Primary Examiner*—David H. Corbin

*Attorney, Agent, or Firm*—M. Ralph Shaffer

[57] ABSTRACT

A threaded bar construction and bar stock and nut combination useful in the mining industry and also in the concrete industry; the bar stock is provided with raised thread segments which appear only on one side of the elongate bar employed, so as to provide for marked reduction in manufacturing costs without detracting from the pull strength or tensioning parameters desired.

8 Claims, 1 Drawing Sheet

THREADED BAR CONSTRUCTION

The present invention relates to bar stock of the threaded variety and, more particularly, to new and improved threaded bar stock that can be inexpensively made, yet preserving its inherent characteristics as to strength and suitability for engagement with appropriate reaction type bearing nuts; this is accomplished by providing threaded segments only on one side of the elongate bar comprising the bar stock.

A BRIEF DESCRIPTION OF PRIOR ART

Threaded shafts, bars, rods, and bolts are common in various industries. So far as the mining and concrete industries are concerned, it would be highly desirable to be able to manufacture bar stock having threads, headed ends, and the like wherein the cost of manufacturing can be drastically reduced. In times past spiraled threads have been provided bars, rods, shafts and the like. The cost of producing such bars, where the threads are continuous and describe helices, for example, is very expensive. For cost savings, machining of the threads is not an option. Yet, it is difficult to provide uniform threads on bars in another manner.

Certain manufacturers have felt that there must be a better way for producing threaded bars where the expense of machining is minimized if not avoid altogether. One type of approach is that shown in U.S. Pat. No. 4,630,971, registered Dec. 23, 1986. This patent illustrated thread segments which are not continuous throughout the bar periphery rather are series of segments on opposite sides of the bar, with spacing between adjacent ends of the segments. In this approach, and by a hot forming process, by way of example, the threaded segments can be produced on opposite sides of the bar by use of a suitable mandrel, forming dies, and so forth, whereby the thread segments can be supplied the bar at substantially reduced cost. The problem here, however, is the fact that in the manufacturing and process of such a bar, it often becomes very difficult to align exactly and in identical pitch the mutually opposite, continuing thread segments on the bar. This is especially true in manufacturing processes that do not employ machining or other expensive fabricating processes.

A BRIEF DESCRIPTION OF THE PRESENT INVENTION

According to the present invention, thread segments, having a desired thread pitch in their mutual angulation, are disposed only on one side of the bar, leaving the other side bare, i.e. totally free of threads. This approach results in a drastic reduction in manufacturing costs of the bar; yet, thread shear strength and pull-strength of bar-nut combinations are not reduced. This is especially the case where the widths of the thread bases is much larger, perhaps over two times larger, than the valleys between the threads. The retainer nuts can be designed appropriately to have their internal threads, disposed completely about the interior of the nut, match in mutual correspondence the thread segments of the bar.

At all events, the strength of the material of the engaging nut will be chosen to be very much greater than the threads of the rod or bar stock. Valleys between the thread segments of the bar stock can be chosen to be very small relative to the threads. This enables a reduction in the length of the nut without detracting from the strength of the entire combination. Other types of thread-valley designs can be employed, as for example where the threads, e.g. at their bases, are equivalent in width to the inter-thread valleys, this so as to accommodate the usual approach as to machining the interior of the nut, by way of example.

The resultant bar stock can be rolled, by way of example, or a mandril forming is used, whereby to provide ridges or thread segments between successive valleys. The inter-thread valleys themselves may, if desired, be disposed interior of the over-all circular orientation of the bar, this so as to produce through a flow-of-materials technique, the desired, mutually spaced thread segments.

Incorporated herein by way of reference is publication designation: F432-83, published by the American Society for Testing and Materials ("ASTM"). It is contemplated that the manufacturer of the subject bar stock will conform to this specification, to be suitable for segmentation such that the segments can be used as roof bolts, rock bolts, accessories, and so forth. Where segments of the subject bar stock are employed, then bolts can be headed in fabrication, provided with cold-rolled threads, and used with devices to hold up mine roofs, hold back walls, or to hold down equipment or foundations. Elongate bar segments can also be employed in the concrete industry as reinforcing bars, with headed nuts or other threaded reaction members, threaded couplings, and so forth.

OBJECTS

According, a principal object of the present invention is to provide new and improved threaded bar stock.

A further object is to provide an improved threaded bar stock and retainer nut combination.

An additional object is to provide threaded bar stock wherein manufacturing costs can be reduced to a minimum, this by supplying thread segments only one side of the bar stock.

An additional object is to provide a threaded bar stock wherein the threads utilized, and found on solely one side of the bar stock, are designed for maximum shear strength.

IN THE DRAWINGS

The present invention, both as to its organization and operation, may best be understood by reference to the following description, taken in connection with the accompanying drawings, in which.

DETAILED DESCRIPTION OF PREFERRED EMBODIMENTS

Figure 1:
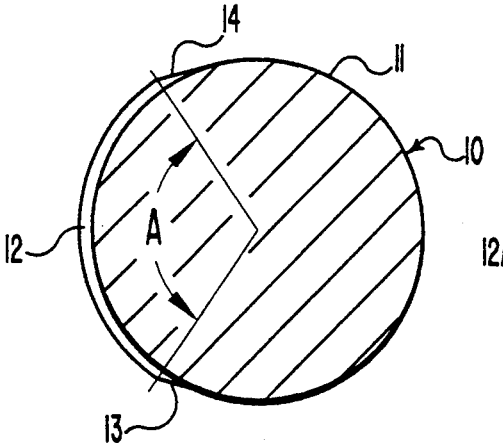
FIG. 1 is a transverse cross section of representative bar stock contemplated in one form of the invention.

In FIG. 1 bar stock 10 has a generally transverse circular configuration and includes elongate bar 11 and, integrally provided with a series of raised thread segments 12. The raised threaded segments 12 are integrally formed with the elongate bar 11 by means of rolling or otherwise forming in connection with customary practices. It is seen in FIG. 1 that the raised height of the thread pattern, comprised of thread segments 12 and disposed in a regular, i.e. non-twist configurement, is essentially uniform, but with the ends of the segments being somewhat sharply tapered at 13 and 14 into the circumference 15 of bar 11. An optimal angular dimension A, as seen in FIG. 1, will be of the order of 110 degrees, i. e., going from approximately one end of the raised thread segment to the other end. At all events, the thread will be less than 180 degrees relative to the over-all transverse circumference of bar 11.

Figure 1A:
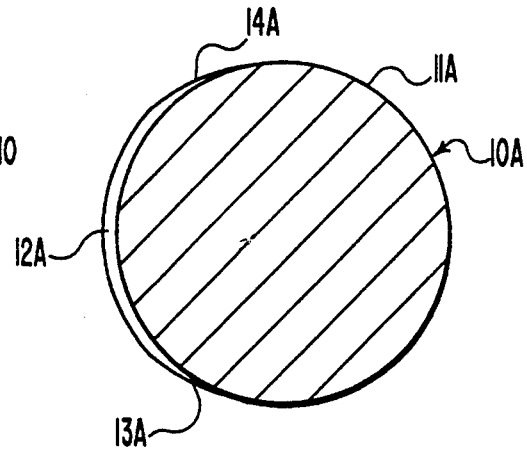
FIG. 1A is similar to FIG. 1 but illustrates an alternate embodiment of bar stock which is contemplated.

In FIG. 1A, bar stock 10A is similar to that shown in FIG. 1; however, the elongate bar this time includes raised threaded segments 12A the ends 13A and 14A of which are generally arcuate and feather into the outer periphery of the elongate bar 11A. According, rather than an abrupt stop of the respective threaded segments as at 13 and 14 in FIG. 1, there may exist a gradual taper, even a slightly arcuate taper of the thread leading into the periphery at points less than 180 degrees apart as to the bar stock's circumference.

Figure 2:
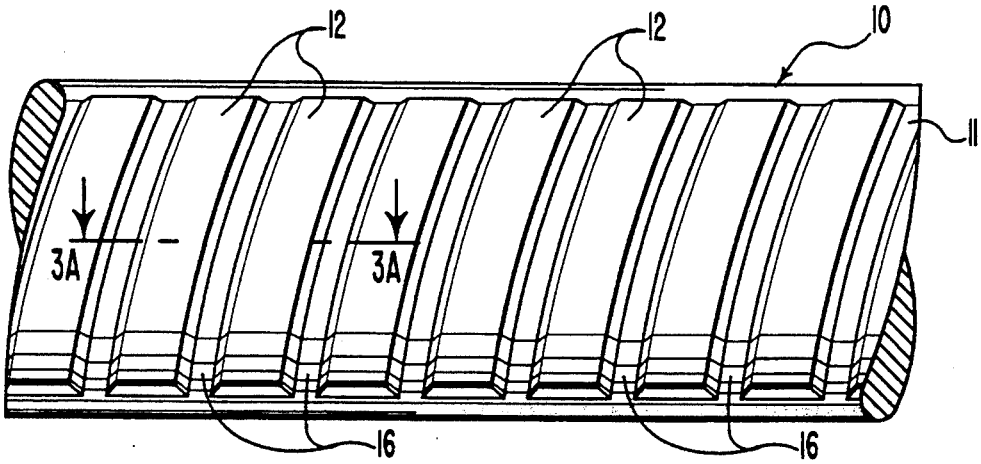
FIG. 2 is a fragmentary side elevation of the bar stock of FIG. 1, by way of example, indicating its thread pattern.

In FIG. 2 the bar stock 10 illustrates that the subject elongate bar 11 has a series of raised thread segments 12 which are mutually spaced apart and which have a customary inter-thread pitch, this to accommodate the turning of the nut on the thread segments of such bar stock 10.

Figure 3A:
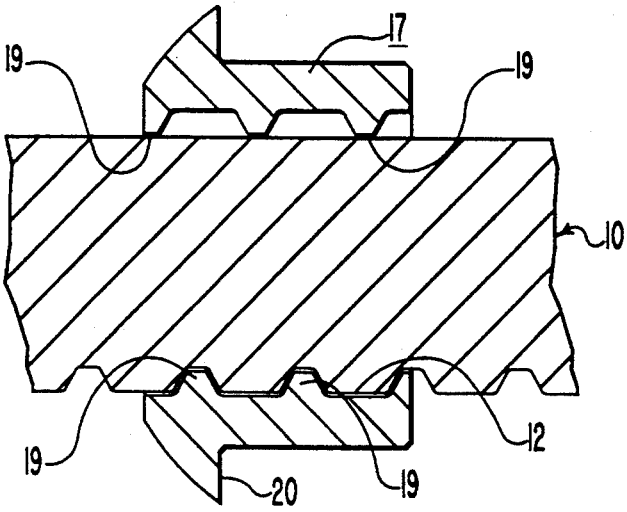
FIG. 3A is a horizontal fragmentary section, looking downwardly, and taken along the line 3A—3A in FIG. 2.
Figure 3B:
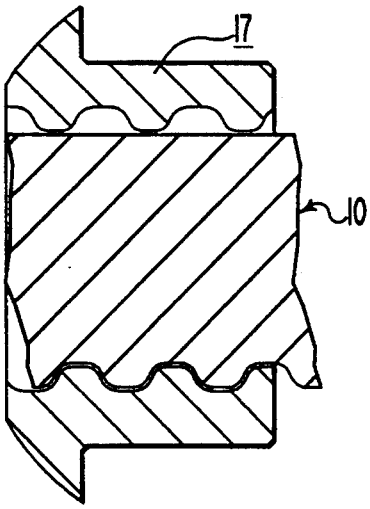
FIG. 3B is similar to FIG. 3A, but illustrates an alternate, optional thread pattern used in connection with the bar stock and the nut engaging the same.

FIG. 3A illustrates that these raised thread segments 12, through the threading action of nut 17, position themselves in the inter-thread valleys 18 of the nut. In a preferred form of the invention, the thread segment widths 12 are in excess of twice the respective widths of the inter-thread respective valleys. This is for the purpose of reducing the length of the engagement nut 17, yet still preserving the pull-strength of the combination when the same is placed in tension. 0f course, lesser loads could be contemplated or the nuts simply lengthened whereby valley width and thread segment width are approximately equivalent as seen in FIG. 3B.

The thread ridges 19 of nut 17 will constitute the locus of an internal imaginary cylinder. As to the inter-thread valleys 16 in FIG. 2, these can coincide with the general outer cylindrical surface of the bar; or, in some rolling type of operations in a hot rolling process, the valleys may descend slightly into the bar stock beneath its general circular periphery and, via a standard plastic phenomenon, produce the raising of the screw-thread-pitched, thread segments into a type of forming device.

The fact that the thread segments are only on one side of the bar stock immeasurably reduces the cost of production of such bar stock. Yet, pull strength is not sacrificed. The latter is especially true where the thread widths are enlarged relative to the inter-thread segment valleys. With such a configurement, the actual dimension of the nut 17 need not be enlarged but rather can be made of high strength material whereby to accommodate the widthwise enlarged threads and yet maintain the pull strength of the over-all nut-bar construction.

Maintaining the raised thread segments on solely one side of bar 11 renders the other side unobstructed and free to move against the ridge portions of the nut then adjacent such bare side.

When the nut is turned, then its pitched, uniform circular threads engage the thread segments on the bar stock so as to produce the advancement of the nut because of its rotation thereon. The nut, of course, can serve as a reactionary member for thrusting against an external member by shoulder 20, thereby enabling a tensioning of the bar stock to satisfy engineering requirements.

The threaded bar stock construction is suitable for production in very long lengths. These lengths can be cut or segmented into appropriate pieces to constitute mine roof bolts, mine anchor bolts, concrete-construction rebar, and so forth.

While particular embodiments of the present invention have been shown and described, it will be obvious to those skilled in the art that various changes and modifications may be made without departing for the essential. Therefore, the aim of the appended claims is to cover all such changes and modifications as fall within the true spirit and scope of the invention.

I claim:

1. Elongated bar stock comprising: an elongate bar of nominally circular transverse cross-section, having a longitudinal axis, and also having opposite, rectilinearly parallel sides each of essentially one-hundred-eighty-degree peripheral extent, and plural, mutually spaced, raised, arcuate thread segments, comprising a regular thread pattern, integral with and disposed solely at one of said sides of said bar, the remaining one of said sides being free of threads, respective opposite ends of said thread segments essentially lying in respective, essentially straight lines parallel to each other and to said longitudinal axis of said bar.

2. The elongated bar stock of claim 1 wherein said segments are essentially mutually parallel and have respective opposite extremities which are mutually rectilinearly aligned and which taper at their respective extremities into the periphery of said elongate bar.

3. The elongated bar stock of claim 1 wherein said segments are essentially mutually parallel and have respective, angulated opposite extremity ends meeting the periphery of said elongate bar.

4. The elongated bar stock of claim 1 wherein said threads are roll-formed on said elongate bar.

5. The elongated bar stock of claim 1 wherein said thread segments are dimensioned such that the heights of said thread segments and their extent at said one side are such that a leading thread segment can engage the cooperating, inwardly annular threads of an external nut to be threaded onto said elongated bar stock.

6. The elongated bar stock of claim 1 wherein said thread segments span of the order of one-hundred-ten degrees of the circumference of said elongate bar.

7. An elongated threaded member having a longitudinal axis and comprising: an elongate bar of nominally circular cross-section and having opposite, regular sides each of 180 degree extent, and mutually parallel thread segments disposed solely on one of said sides of said bar, the remaining side of said bar being bare of threads, respective opposite ends of said thread segments essentially lying in respective, essentially straight lines parallel to each other and to said longitudinal axis of said bar.

8. In combination, a nut member having as to longitudinal cross-section inner threads defining thread ridges separated by valleys, and an elongate bar of nominally circular cross-section, provided a longitudinal axis, and having opposite, regular sides each of 180 degree extent, said elongate bar having thread segments disposed solely on one of said sides of said bar and engaging and constructed to threadedly slide along said valleys as said nut member is threadedly turned on said elongate bar, respective opposite ends of said thread segments essentially lying in essentially straight lines parallel to each other and to said longitudinal axis of said bar.

* * * * *